US007243739B2

(12) United States Patent
Rankin, III

(10) Patent No.: US 7,243,739 B2
(45) Date of Patent: Jul. 17, 2007

(54) COILED TUBING DIRECTIONAL DRILLING APPARATUS

(76) Inventor: Robert E. Rankin, III, 26426 120 St., Wayne, OK (US) 73095

( * ) Notice: Subject to any disclaimer, the term of this patent is extended or adjusted under 35 U.S.C. 154(b) by 360 days.

(21) Appl. No.: 11/074,998

(22) Filed: Mar. 8, 2005

(65) Prior Publication Data

US 2005/0236189 A1 Oct. 27, 2005

Related U.S. Application Data

(60) Provisional application No. 60/552,150, filed on Mar. 11, 2004.

(51) Int. Cl.
*E21B 7/08* (2006.01)

(52) U.S. Cl. ..... 175/73; 175/75

(58) Field of Classification Search ..... None
See application file for complete search history.

(56) References Cited

U.S. PATENT DOCUMENTS

| | | | | |
|---|---|---|---|---|
| 4,811,798 | A | 3/1989 | Falgout et al. | 175/73 |
| 4,880,066 | A | 11/1989 | Steiginga | 175/75 |
| 4,995,465 | A | 2/1991 | Beck et al. | 175/27 |
| 5,113,953 | A | 5/1992 | Noble | 175/61 |
| 5,188,174 | A | 2/1993 | Anderson, Jr. | 166/77 |
| 5,265,687 | A | 11/1993 | Gray | 175/62 |
| 5,311,952 | A | 5/1994 | Eddison et al. | 175/61 |
| 5,353,884 | A | 10/1994 | Misawa et al. | 175/26 |
| 5,484,029 | A | 1/1996 | Eddison | 175/73 |
| 5,520,256 | A | 5/1996 | Eddison | 175/61 |
| 5,529,133 | A | 6/1996 | Eddison | 175/61 |
| 5,553,678 | A | 9/1996 | Barr et al. | 175/73 |
| 5,575,343 | A | 11/1996 | Gray | 175/61 |
| 6,092,610 | A | 7/2000 | Kosmala et al. | 175/61 |
| 6,129,160 | A | 10/2000 | Williams et al. | 175/107 |
| 6,158,529 | A | 12/2000 | Dorel | 175/61 |
| 6,244,345 | B1 | 6/2001 | Helms | 166/301 |
| 6,415,878 | B1 * | 7/2002 | Cargill et al. | 175/61 |
| 6,419,014 | B1 * | 7/2002 | Meek et al. | 166/255.2 |
| 6,439,618 | B1 | 8/2002 | Beeman et al. | 285/323 |
| 6,571,888 | B2 * | 6/2003 | Comeau et al. | 175/61 |

* cited by examiner

*Primary Examiner*—Frank S. Tsay
(74) *Attorney, Agent, or Firm*—John M. Harrison

(57) ABSTRACT

A coiled tubing directional drilling apparatus which is operated by a mud motor and is characterized by a fixed housing and a rotary steerable bent housing or sub which is selectively rotatable with respect to the fixed housing at a fixed angle bend by a shifting mechanism, typically operated by a reversible electric motor. The motor and shifting mechanism rotate with the drive shaft and employ a lead screw in a cross-nut arrangement that selectively engages and disengages a castle lock or power take-off drive system responsive to the direction of rotation of the motor, for effecting 360-degree rotation of the bent housing with respect to the fixed housing. A sun gear and pinion gear planetary gear system facilitate rotation of the bent housing with respect to the fixed housing at a slower speed than the drive train and bit box components of the device.

20 Claims, 14 Drawing Sheets

13
12

14
15
1
14
16

15b
18a
A'
1
18a
15a
15
18
15b
20
18
18a
15a
17
20
18a
A'
18a
15b
20
15b
15
18

FIG. 7
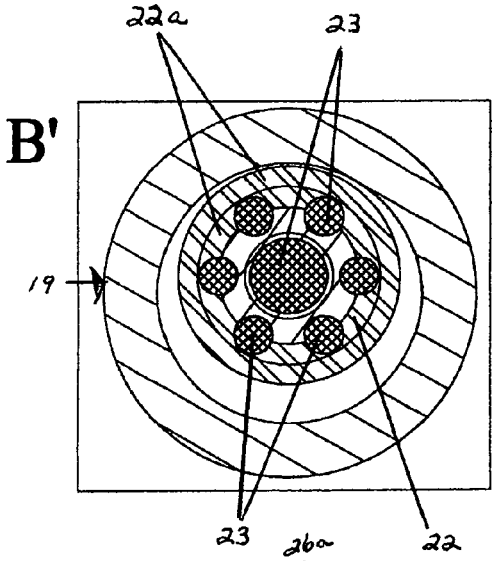
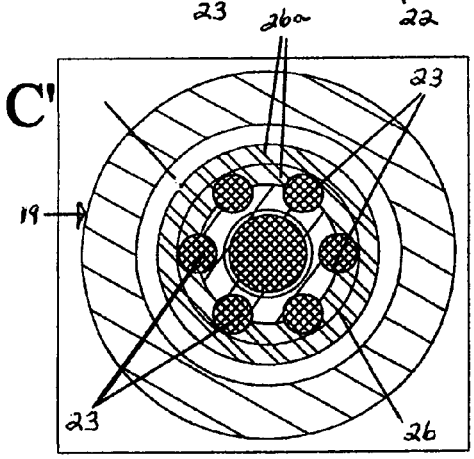
FIG. 8
FIG. 6
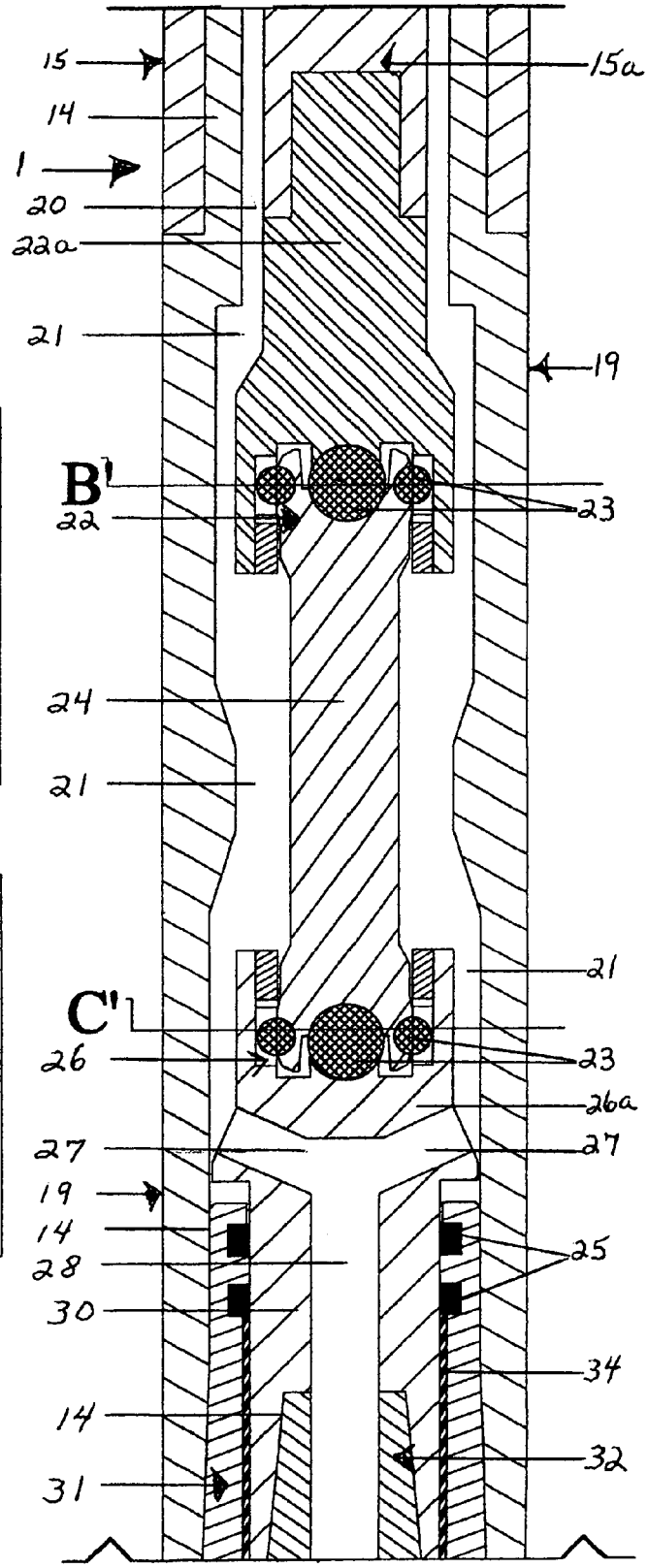

F'

COILED TUBING DIRECTIONAL DRILLING APPARATUS

CROSS-REFERENCE TO RELATED APPLICATIONS

This application claims the benefit of and incorporates by reference prior filed copending U.S. Provisional Application Ser. No. 60/552,150, Filed Mar. 11, 2004.

SUMMARY OF THE INVENTION

This invention relates to directional drilling using coiled tubing and more particularly, to a coiled tubing directional drilling apparatus which is characterized by a fixed housing having one end connected to a length of coiled tubing and a rotatably steerable bent housing or sub extending from the opposite end of the fixed housing at a fixed angle. This mechanical configuration facilitates drilling in a selected direction responsive to operation of a drive train and drill bit which are typically operated by a mud motor located inside the fixed housing. The bent housing is caused to selectively rotate with, as well as with respect to, the fixed housing through a 360-degree range by operation of a clutch or shifting mechanism typically operated by an electric motor connected to a lead screw extending through a cross-nut that engages and disengages a castle lock or power take-off mechanism to and from an elongated sun gear. The elongated sun gear extends downwardly through the fixed housing for engagement with a set of companion pinion gears and sun gears in a planetary gear system to facilitate 360-degree rotation of the bent housing with respect to the fixed housing responsive to engagement of the castle lock or power take-off mechanism with the elongated sun gear. The planetary gears facilitate rotation of the bent housing to selected points on the 360-degree rotational path at a slower speed than the drive train of the drilling apparatus.

BRIEF DESCRIPTION OF THE DRAWINGS

The invention will be better understood by reference to the accompanying drawings wherein:

FIG. 6 is a longitudinal sectional view of the upper mid-section of the coiled tubing directional drilling apparatus illustrated in FIG. 3, more particularly illustrating a pair of torque transfer universal, or CV joints therein;

FIG. 7 is a cross-sectional view taken along line B' of the coiled tubing directional drilling apparatus illustrated in FIG. 6, more particularly illustrating lateral movement of the upper CV joint inside the CV housing;

FIG. 8 is a cross-sectional view taken along line C' of the coiled tubing directional drilling apparatus illustrated in FIG. 6, more particularly illustrating substantial alignment of the lower CV joint in the CV housing;

DESCRIPTION OF THE PREFERRED EMBODIMENTS

Figure 1:
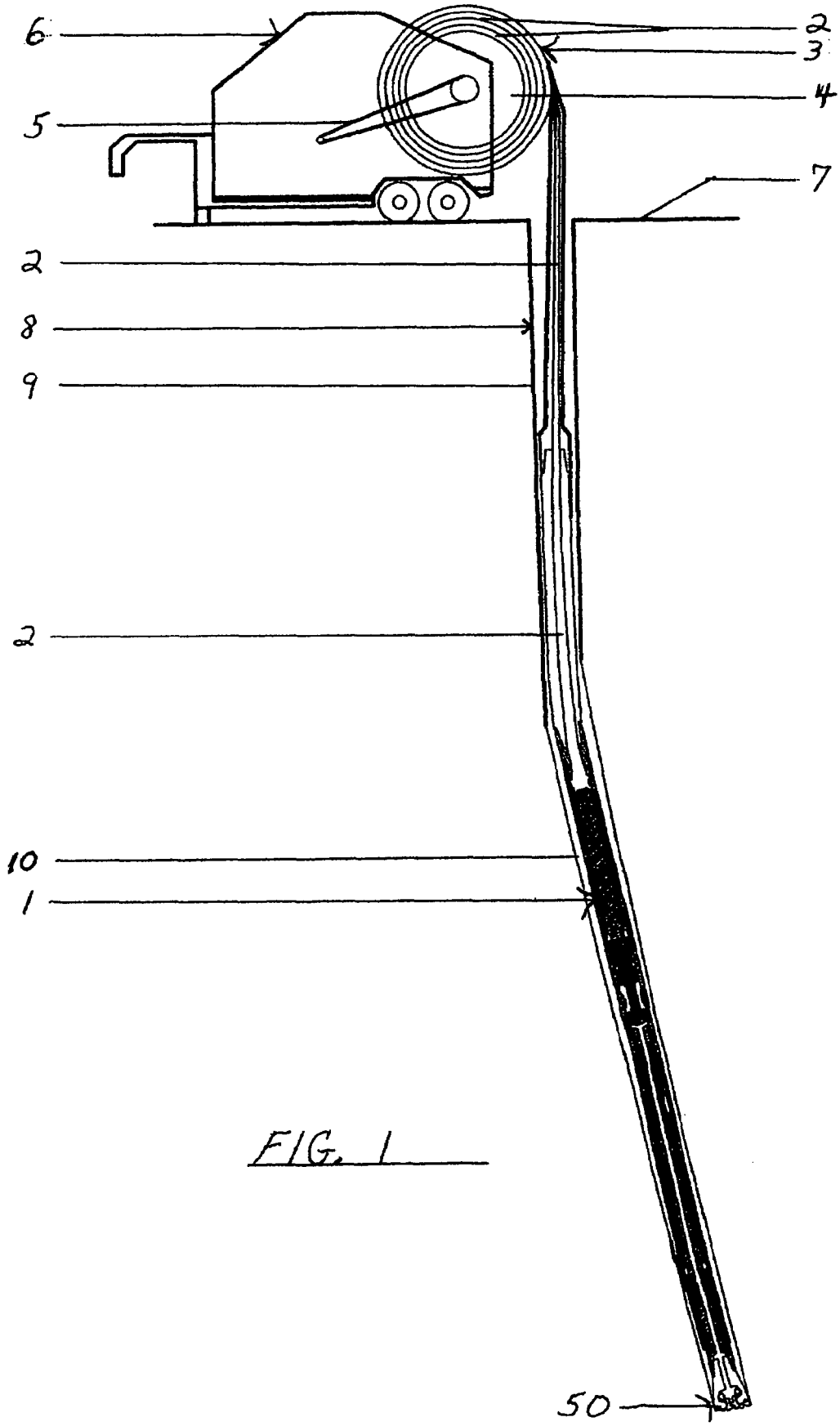
FIG. 1 is a plan view of a typical operational embodiment of the coiled tubing directional drilling apparatus, illustrating suspension of the apparatus into a well bore by means of a length of coiled tubing extending from a coiled tubing coil mounted on a carrier.
Figure 3:
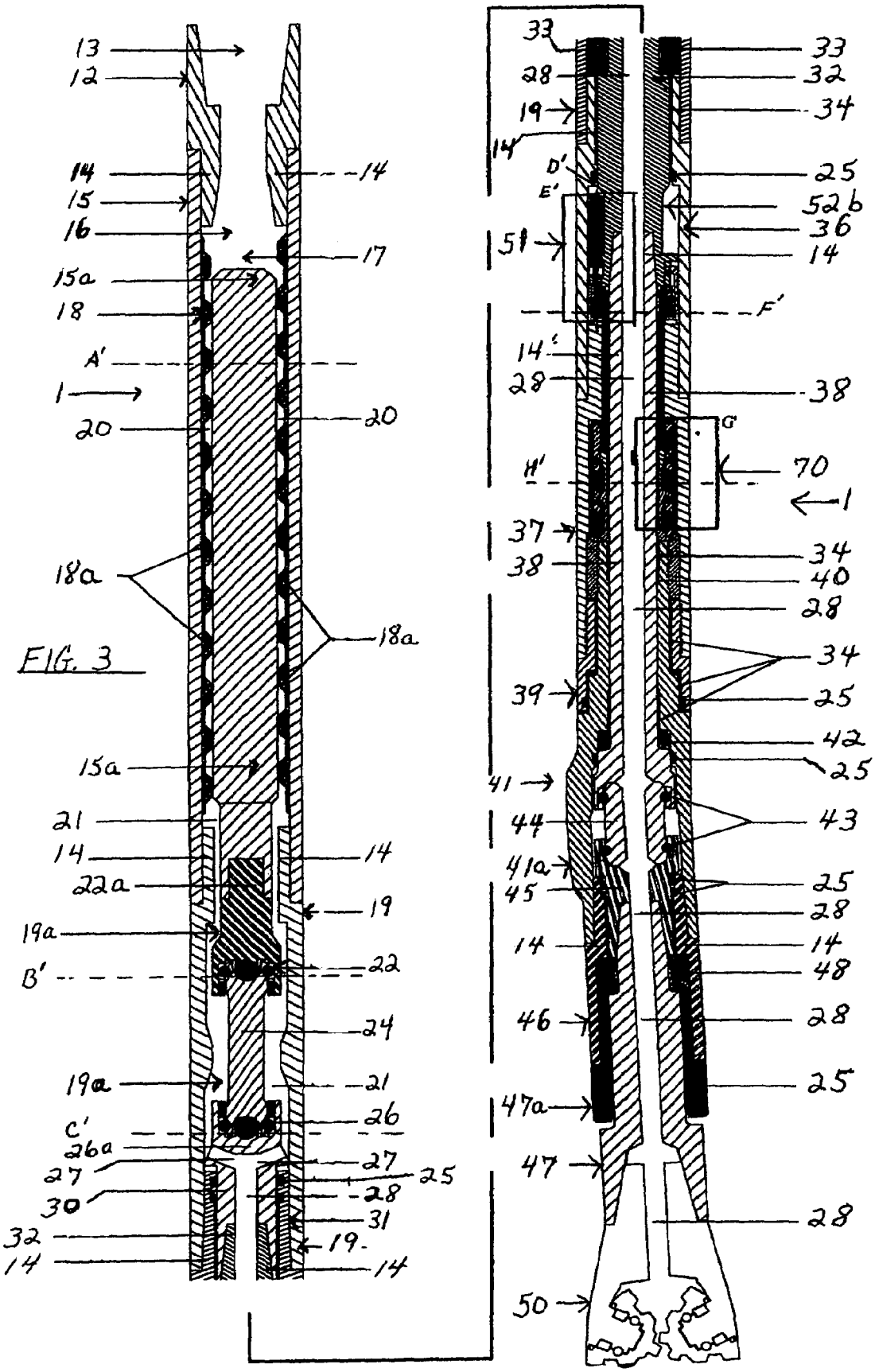
FIG. 3 is a longitudinal sectional view of a preferred embodiment of the coiled tubing directional drilling apparatus illustrated in FIGS. 1 and 2.
Figures 4, 5:
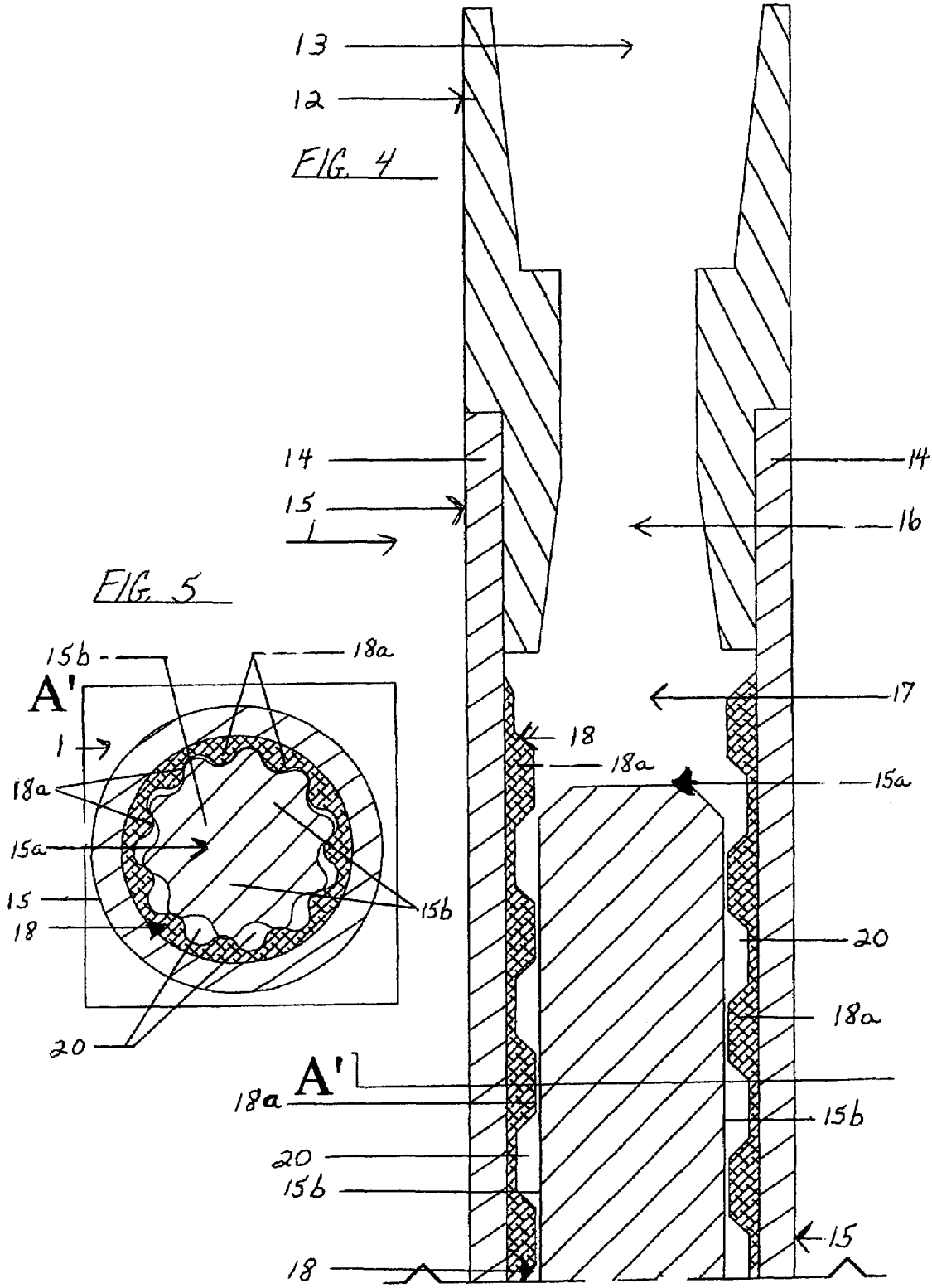
FIG. 4 is a longitudinal sectional view of the upper portion of the coiled tubing directional drilling apparatus illustrated in FIG. 3.
FIG. 5 is a cross-sectional view taken along line A' of the coiled tubing directional drilling apparatus illustrated in FIG. 4, more particularly illustrating a mud motor component of the coiled tubing directional drilling apparatus.

Referring initially to FIGS. 1 and 3 of the drawings in a first operational configuration the coiled tubing directional drilling apparatus of this invention is generally illustrated by reference numeral 1 and is positioned in an offset leg 10, which connects to the vertical leg 9 of a well bore 8, extending from a horizontal surface 7. The coiled tubing directional drilling apparatus 1 is attached to a length of coiled tubing 2 which extends downwardly into the well bore 8 from a tubing coil 3, wound on a drum 4 which is rotatably attached to a carrier 6, typically by means of a drive chain 5. The coiled tubing 2 extends from the tubing coil 3 downwardly through the vertical leg 9 of the well bore 8 and into the offset leg 10, where it connects to the top sub 12 of the coiled tubing directional drilling apparatus 1, illustrated in FIG. 3 of the drawings. A drill bit 50 is located at the extreme bottom end of the coiled tubing directional drilling apparatus 1 and is positioned at the end of the offset leg 10, as further illustrated in FIG. 1 of the drawings.

Figure 2:
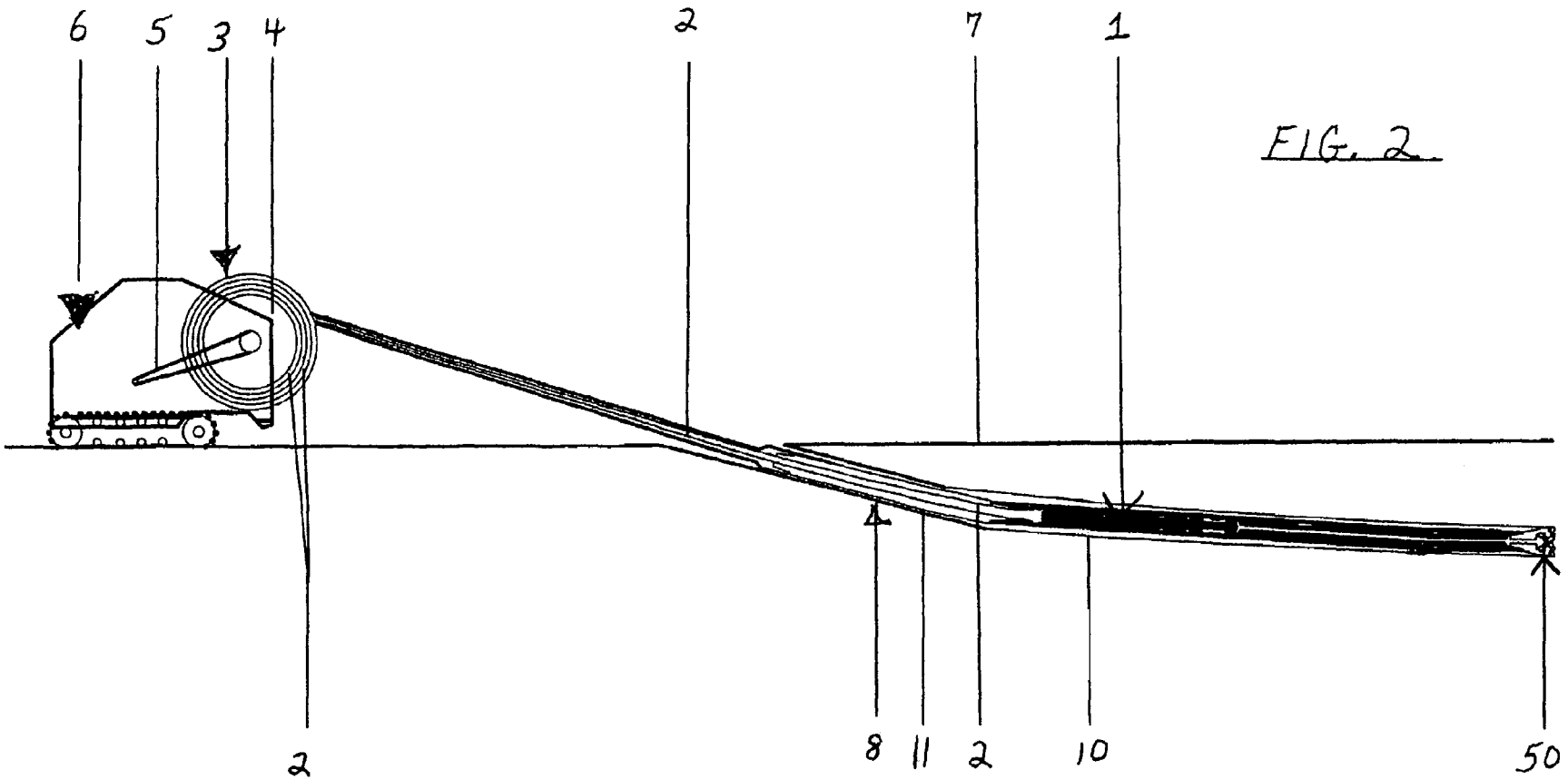
FIG. 2 is a plan view of the coiled tubing directional drilling apparatus illustrated in FIG. 1, more particularly illustrating a substantially horizontal operation of the apparatus, also using the coiled tubing extending from a coiled tubing coil mounted on a carrier.

Referring now to FIG. 2 of the drawings in another operational configuration the coiled tubing directional drilling apparatus 1 is set-up for horizontal boring, as it is positioned in the offset leg 10 extending from an angled leg 11 that projects from the horizontal surface 7. As in the case of the configuration illustrated in FIG. 1, the coiled tubing directional drilling apparatus 1 is attached to a length of coiled tubing 2 that extends from a tubing coil 3, rotatably mounted on a carrier 6 and typically operated by means of a drive chain 5 in conventional fashion.

Referring to FIGS. 3-6 of the drawings in a preferred embodiment of the invention the coiled tubing directional drilling apparatus 1 is characterized by a top sub 12, which is adapted to receive and mount the free end of a length of coiled tubing 2, as illustrated in FIGS. 1 and 2 of the drawings. The coiled tubing 2 can be attached to the top sub 12 in any convenient manner known to those skilled in the art. A top sub bore 13 extends through the center of the top sub 12 and the top sub 12 is typically threaded to the upper or top end of a stator tube 15 by means of threads 14. The stator tube 15 is characterized by a stator tube bore 16 that receives the rubber transfer section 18 of a mud motor 17. The rubber transfer section 18 is typically characterized by spirally-shaped transfer lobes 18*a* that correspond to the companion rotor lobes 15*b* (FIG. 5) of a rotor 15*a*, which is rotatably disposed in the stator tube bore 16 to complete the mud motor. Accordingly, a supply of drilling mud (not illustrated) pumped through the coiled tubing 2 into the top sub bore 13 and the stator tube bore 16, and through a power annulus 20 defined by the rotor lobes 15*b* of the rotor 15*a* and the transfer lobes 18*a* of the rubber transfer section 18, facilitates rotation of the rotor 15*a* in the rubber transfer section 18 to power the coiled tubing directional drilling apparatus 1. The top end of a universal or CV housing 19 is typically attached to the bottom end of the stator tube 15 by additional threads 14 and the bottom end of the rotor 15*a* terminates in a mud annulus 21 that communicates with the CV housing bore 19*a*. A CV joint top end 22*a* is attached to the narrowed bottom end of the rotor 15*a* and mounts a top CV joint 22, as further illustrated in FIGS. 3 and 6. The top CV joint 22, in turn, mounts a downwardly-extending CV drive shaft 24 that connects to a bottom CV joint 26, also located in the CV housing bore 19*a* of the CV housing 19, for alternating wobble in torque transition. Drilling mud flowing through a mud annulus 21, extending the CV housing bore 19*a*, is diverted around the bottom CV joint 26 and the CV joint bottom end 26*a*, through the mud transfer passages 27 and into a mud bore 28, all provided in a downward-extending top bearing drive shaft 30. The top bearing drive shaft 30 is connected to or integrally formed with the CV joint bottom end 26*a* and is seated in a top bearing housing 31, connected to the bottom end of the CV housing 19, typically by additional threads 14, and the seals 25 serve to seal the joint between the top bearing drive shaft 30 and the top bearing housing 31 above the bushing 34 (FIG. 6).

Figure 9:
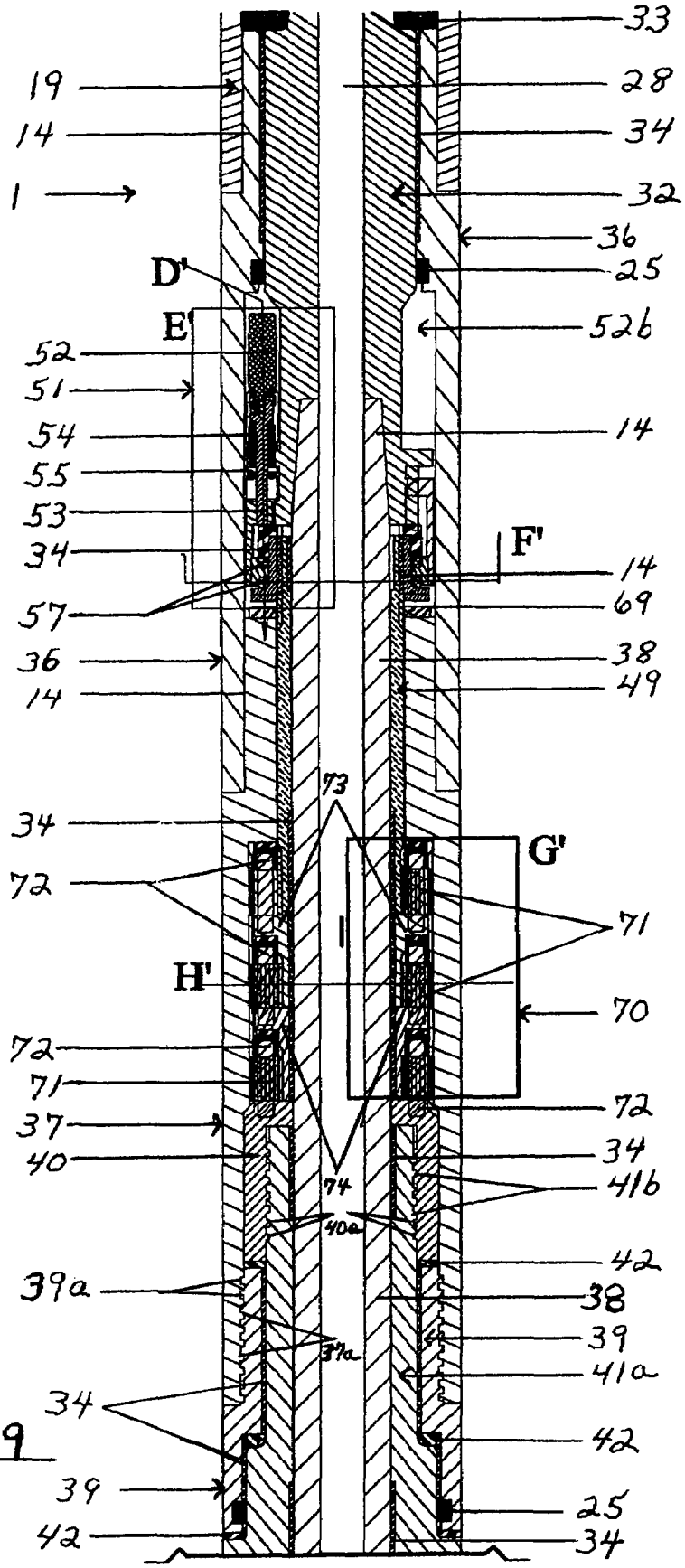
FIG. 9 is a longitudinal sectional view of the lower mid-section of the coiled tubing directional drilling apparatus illustrated in FIG. 3, more particularly illustrating preferred shifting and pinion gear assemblies of the apparatus.

Referring now to FIGS. 3, 6 and 9 of the drawings a bearing drive shaft 32 is provided in the CV housing 19 and connects to the top bearing drive shaft 30, typically by additional threads 14, as further illustrated in FIG. 3. A top thrust bearing 33 is seated in the bottom end of the CV housing 19 and in the bearing drive shaft 32 at the top end of the shifting mechanism housing 36, which is typically secured to the bottom end of the CV housing 19 by additional threads 14. A bushing 34 is provided between the bearing drive shaft 32 and the upper end of the shifting mechanism housing 36 to facilitate reduced friction during rotation of the bearing drive shaft 32 with respect to the fixed shifting mechanism housing 36. A seal 25 is also typically provided between the shifting mechanism housing 36 and the internal bearing drive shaft 32, as further illustrated in FIGS. 3 and 9.

A shifting mechanism assembly 51 is mounted in the bearing drive shaft 32 for purposes which will be hereinafter further described and a gear housing 37 extends downwardly from threaded attachment at additional threads 14 to the bottom end of the shifting mechanism housing 36, as further illustrated in FIGS. 3 and 9. A gear housing drive shaft 38 is attached to the bottom end of the bearing drive shaft 32, typically by additional threads 14, to facilitate continued rotation of the gear housing drive shaft 38 with the bearing drive shaft 32 and upper drive train, as hereinafter further described.

A pinion gear assembly 70 is provided in the coiled tubing directional drilling apparatus 1 below the shifting mechanism assembly 51 and between the gear housing 37, having gear housing teeth 37*a* at the lower end, and the gear housing drive shaft 38, for rotating a bent section 41, 360-degrees, as further illustrated in FIGS. 3, 9 and 16 of the drawings. Furthermore, a gear bearing housing 39 is secured to the bottom end of the gear housing 37 at the gear bearing housing teeth 39*a*, to mount a bent section housing 41*a* and further accommodate the rotating gear housing drive shaft 38 (FIGS. 3 and 9), as hereinafter described. A planet gear sub 40 also extends upwardly from the gear bearing housing 39 to the pinion gear assembly 70 (FIG. 9) and is threaded on the bent section housing 41*a* by the planet gear sub threads 40*a* and the bent section housing threads 41*b*.

Figure 10:
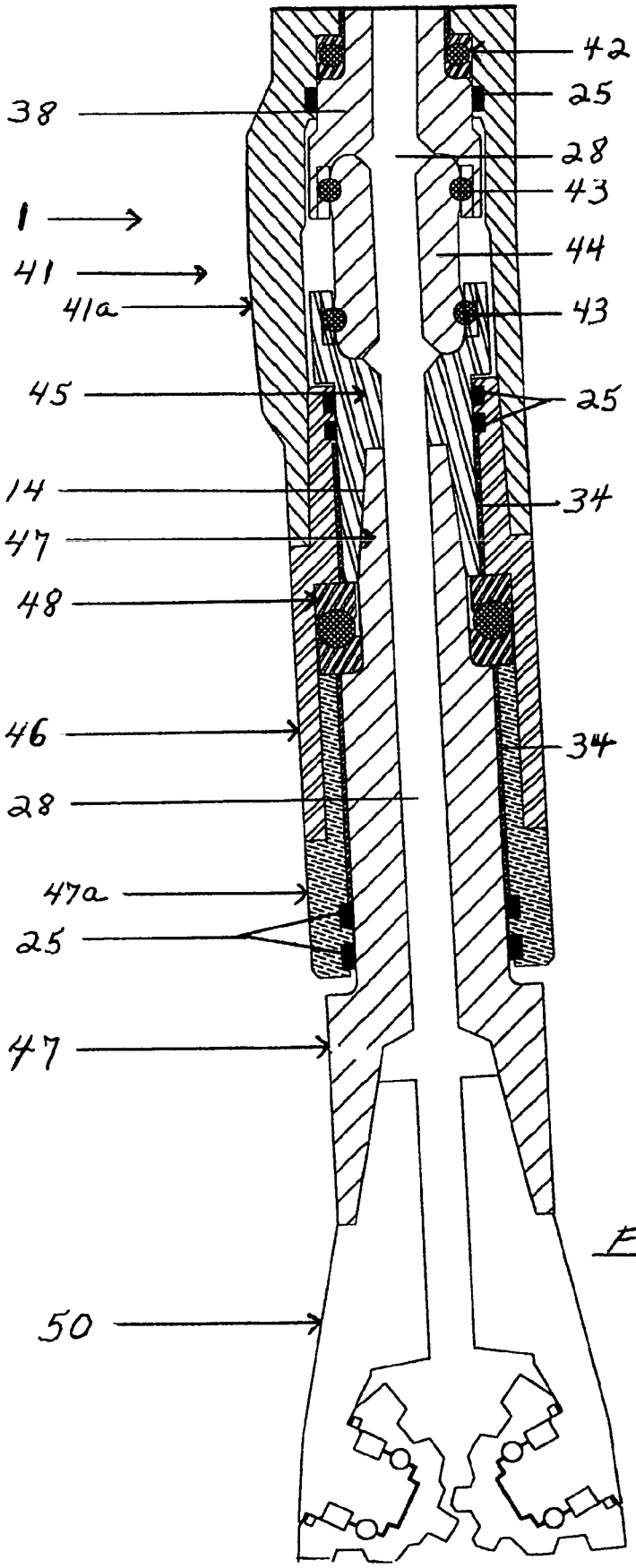
FIG. 10 is a sectional view of the lower section of the coiled tubing directional drilling apparatus illustrated in FIG. 3, more particularly illustrating the bent section, bit box and drill bit components of the apparatus.

Referring now to FIGS. 3, 9 and 10 of the drawings, the bent section 41 extends downwardly from attachment to the planet gear sub 40 and encloses a pair of bent section universal or CV joints 43, attached by a bent section CV joint connector 44, which articulates between the bottom end of the gear housing drive shaft 38 and a correspondingly rotating bent section CV joint support 45. As heretofore described, the bent section housing 41*a* is attached to the bottom end of the planet gear sub 40 (FIG. 9) and a bit box 47 is secured inside a bit box sleeve 47*a*, disposed inside the bit box housing 46. The upper end of the bit box 47 is attached to the bent section CV joint mount 45, seated in the bit box housing 46, typically by threads 14 and a bit box thrust bearing 48 is also seated in the bit box housing 46 above the bit box sleeve 47*a*. Bushings 34 are also provided in the bent section housing 41*a* and a drill bit 50 is attached to the rotating bit box 47, which rotates at the speed of the mud motor rotor 15*a*, as further illustrated in FIGS. 3 and 10 of the drawings.

Figure 11:
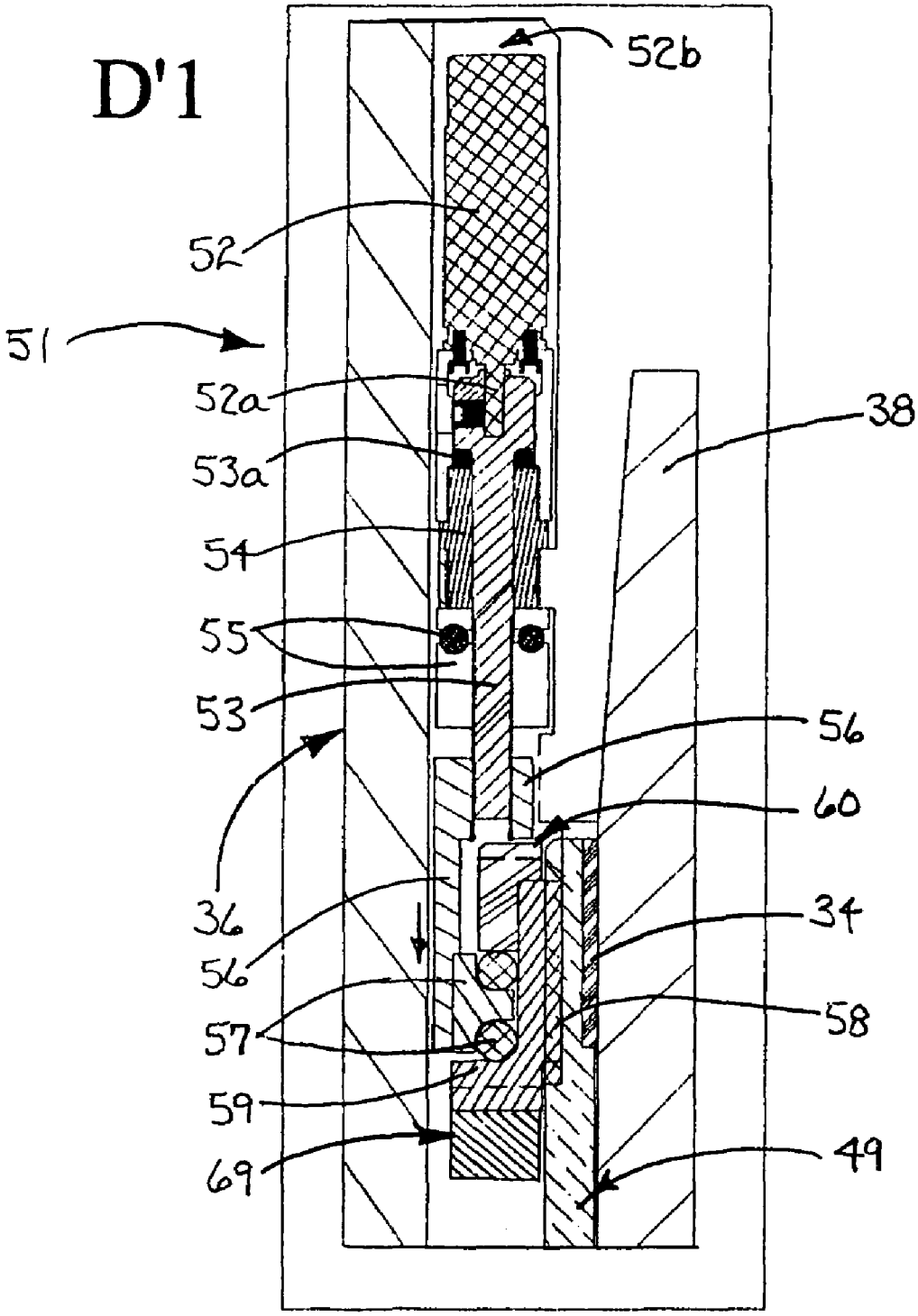
FIG. 11 is an enlarged view of the clutch or shifting mechanism of the coiled tubing directional drilling apparatus illustrated in FIG. 9, more particularly illustrating castle lock apparatus components in disengaged configuration for non-rotation of the bent housing section of the apparatus with respect to the fixed housing.
Figure 12:
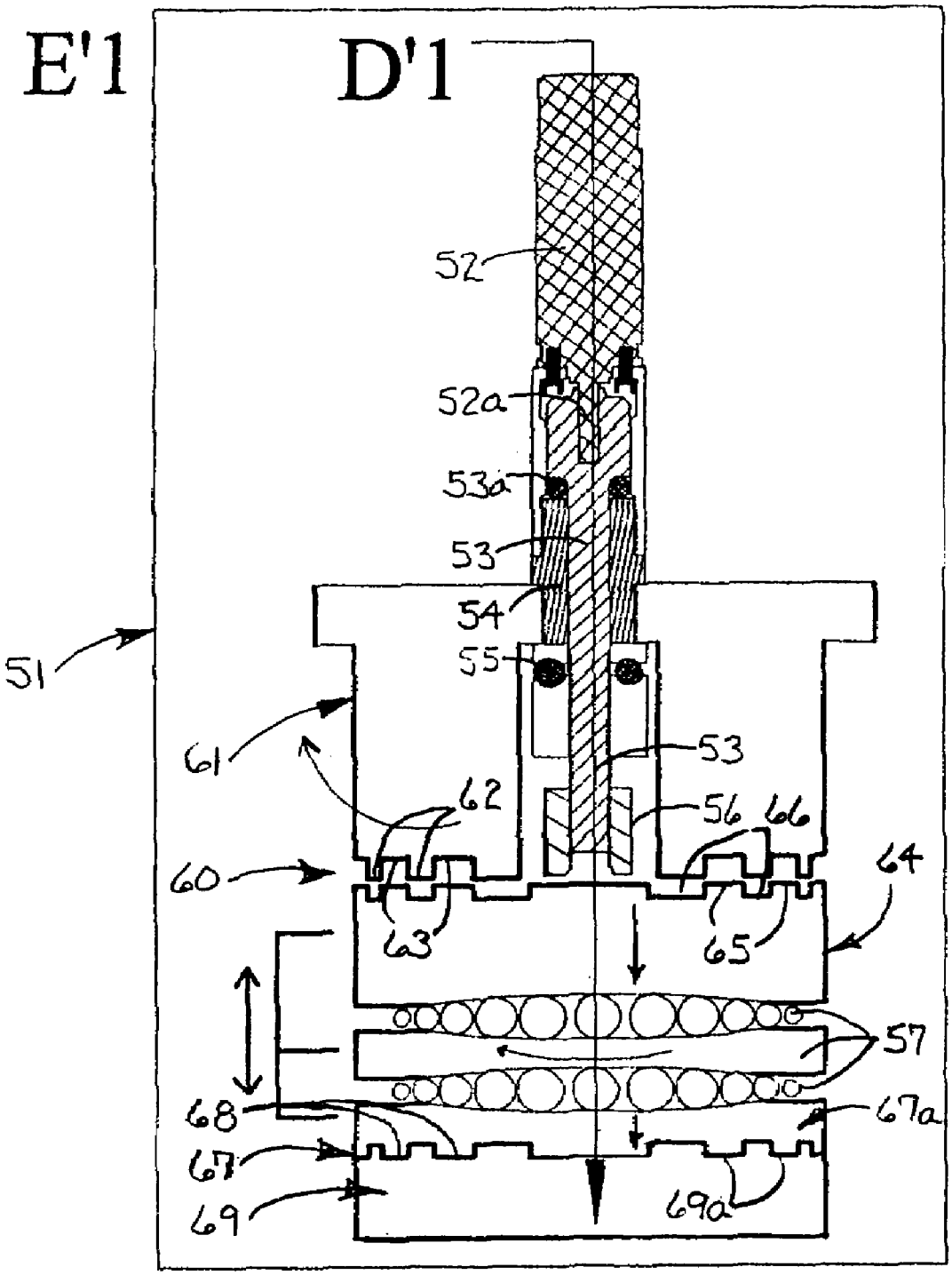
FIG. 12 is an enlarged plan view, partially in section, of the electric motor and castle lock apparatus components of the shifting apparatus illustrated in FIG. 11.

Referring now to FIGS. 9, 11 and 12 of the drawings in one embodiment of the invention the shifting mechanism assembly 51 is illustrated in FIG. 9 in non-engaging configuration, thus facilitating rotation of the mud motor drive train, which includes the rotor 15*a*, the top bearing shaft 30, the bearing drive shaft 32, the gear housing drive shaft 38, the bit box 47 and the drill bit 50, without positional rotation of the bent section 41, including the bent section housing 41*a*. Accordingly, as further illustrated in FIGS. 9, 11 and 12, the shifting mechanism assembly 51 is characterized by a typically electric motor 52, vertically mounted in and rotatable with the gear housing drive shaft 38 in a motor access 52*b* (FIG. 9). The motor shaft 52*a*, extending from the motor 52, is connected to a lead screw 53 that extends through a lead screw guide 54, fitted with lead screw guide bearings 53*a* at the top thereof. The lead screw 53 extends downwardly through a lead screw thrust bearing and housing 55 inside a shaft cap 61 (FIG. 12) and threadably engages an internally-threaded cross-nut 56 (FIGS. 11 and 12). A power take-off or castle lock apparatus is generally illustrated by reference numeral 60 and includes the shaft cap 61, a top castle lock 64 and a bottom castle lock 67, as further illustrated in FIG. 12 of the drawings. The shaft cap 61 is fitted with shaft cap teeth 62 and shaft cap slots 63 that selectively engage the top castle lock slots 66 and top castle lock teeth 65, respectively, as hereinafter further described. The bottom castle lock 67 includes an upper bottom castle lock 67*a*, with upper bottom castle lock teeth 68 and a fixed lower bottom castle lock 69, having companion lower bottom castle lock slots 69*a* for receiving the upper bottom castle lock teeth 68. A castle lock thrust bearing and housing 57 is provided in a thrust bearing mount 59 located at the base of the castle lock apparatus 60, to compensate for upward and downward thrusting of the lead screw 53 (FIGS. 11 and 12).

Accordingly, referring again to FIGS. 11 and 12 of the drawings under circumstances where the lead screw 53 is rotating in a selected first direction inside the cross-nut 56, the top castle lock 64 and upper bottom castle lock 67*a* are moved downwardly (FIG. 12) along with the thrust bearing mount 59 and the castle lock thrust bearings and housing 57 (FIG. 11). This action disengages the respective shaft cap teeth 62 from the corresponding top castle lock slots 66, as well as the top castle lock teeth 65 from the corresponding and opposite shaft cap slots 63 and engages the upper bottom castle lock teeth 68 with the lower bottom castle lock slots 69*a*, to facilitate free rotation of the mud motor drive train defined above without corresponding independent rotation of the bent section 41 illustrated in FIG. 10, thus effectively locking the orientation of the bent section 41.

Figure 13:
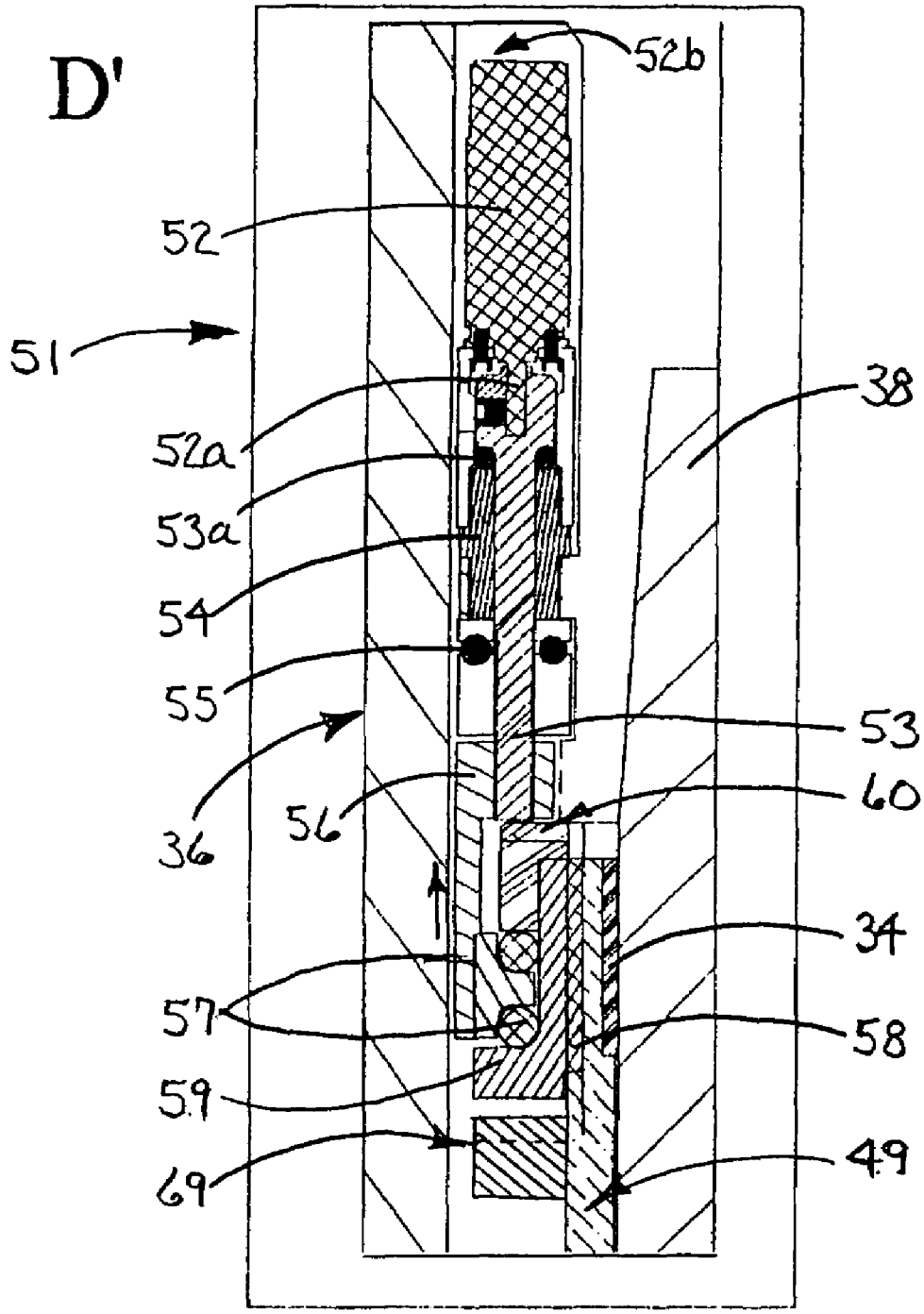
FIG. 13 is an enlarged view of the shifting mechanism of the coiled tubing directional drilling apparatus illustrated in FIG. 9, more particularly illustrating castle lock apparatus in engaged configuration for rotation of the bent housing section of the apparatus with respect to the fixed housing.
Figure 14:
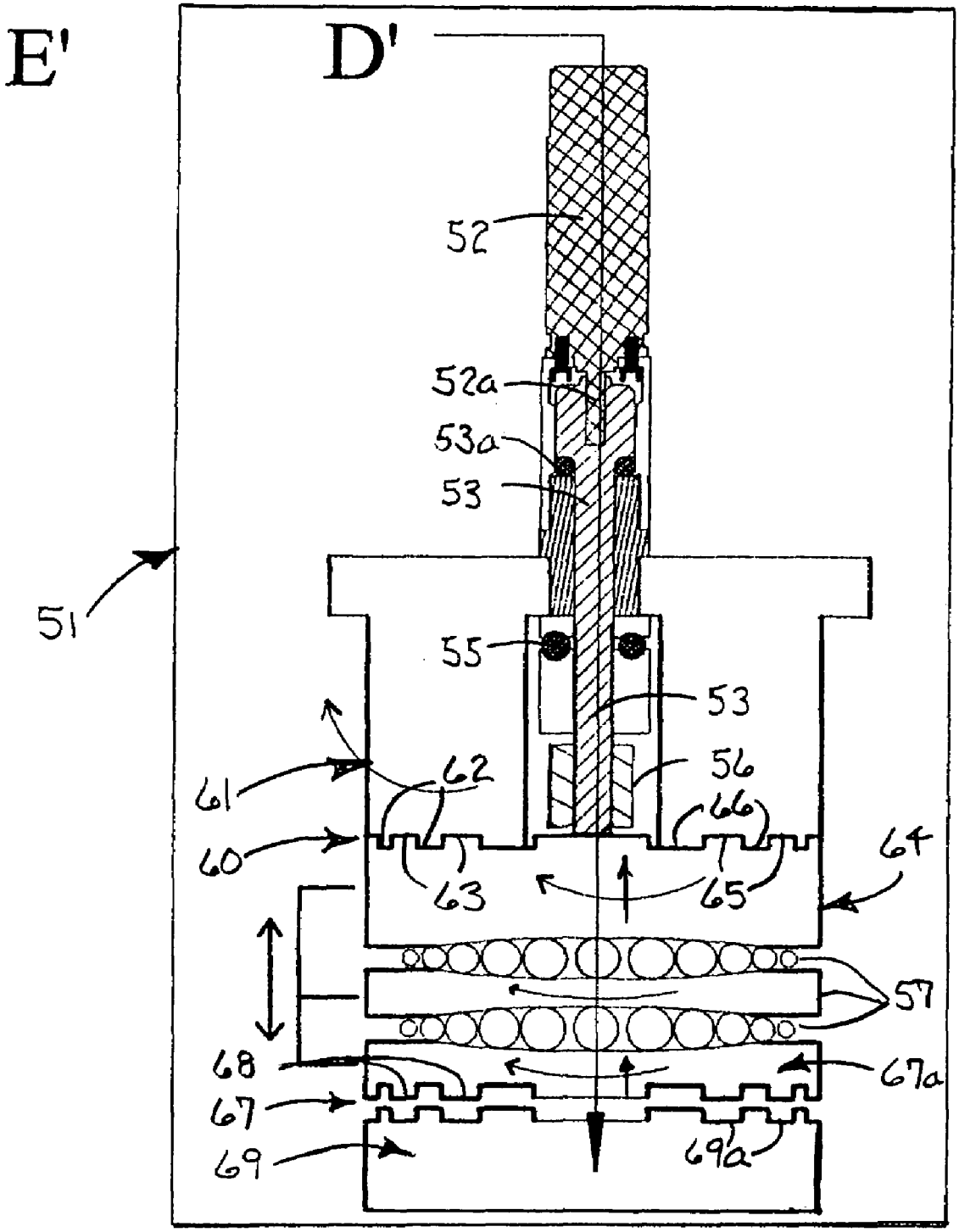
FIG. 14 is an enlarged view partially in section, of the electric motor and castle lock apparatus components of the shifting or clutch apparatus illustrated in FIG. 11.
Figure 15:
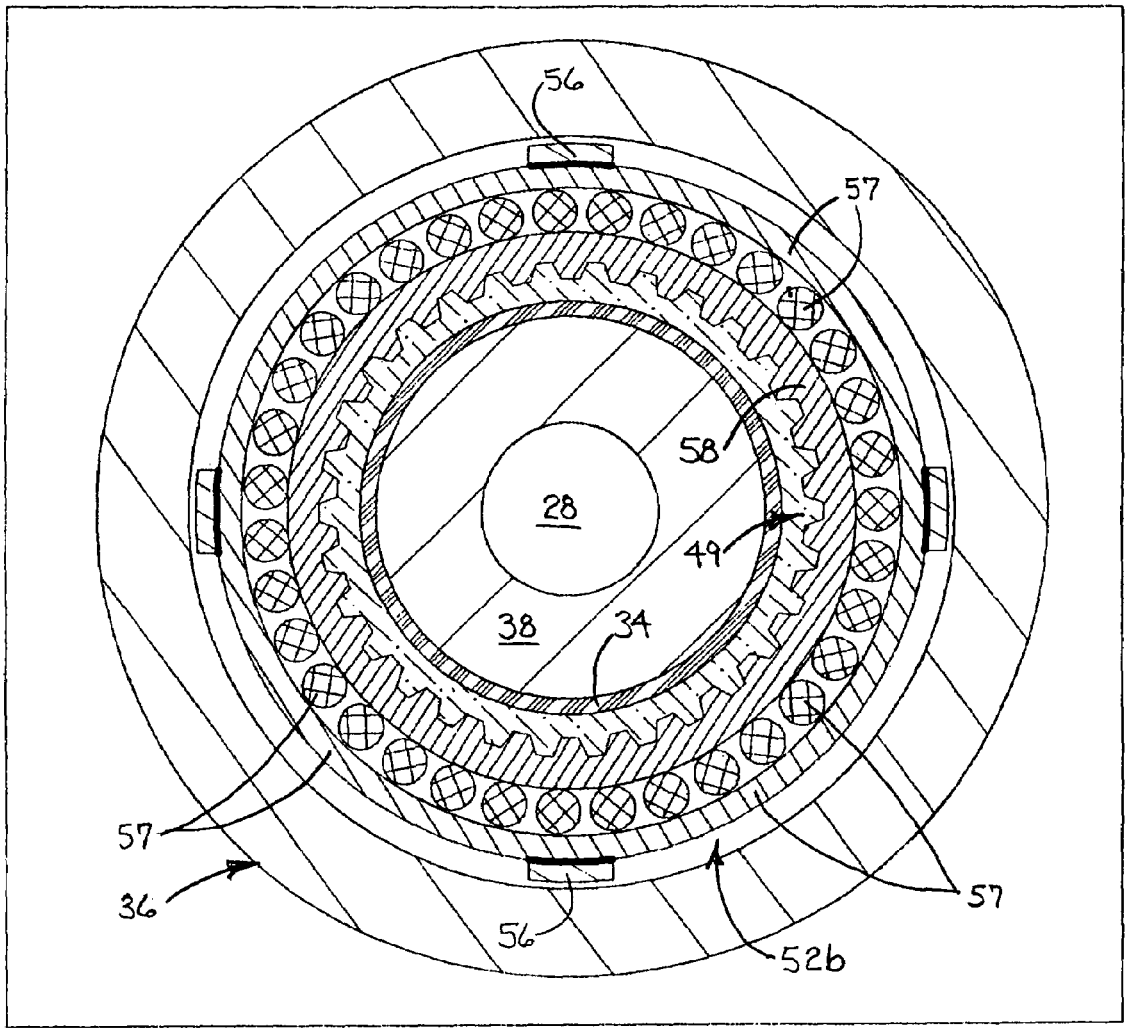
FIG. 15 is a cross-sectional view taken along line F' of the coiled tubing directional drilling apparatus illustrated in FIG. 9, more particularly illustrating the mud bore, drive shaft, bushing, first or elongated sun gear, splined shaft, thrust bearing mount and shifting mechanism cross-nut components of the apparatus.

Conversely, under circumstances where it is desired to positionally rotate the bent section 41 with respect to the shifting mechanism housing 36 in a 360-degree range of rotation using the mud motor drive train torque, the rotational direction of the lead screw 53 is reversed by reversing the rotation of the electric motor 52 and motor shaft 52*a* (typically remote control) to force the top castle lock 64 upwardly, along with the upper bottom castle lock 67*a*, as illustrated in FIGS. 13 and 14, such that the respective shaft cap teeth 62 engage the corresponding top castle lock slots 66 and the top castle lock teeth 65 engage the aligned shaft cap slots 63. This action effects rotation of the top castle lock 64 along with the upper bottom castle lock 67*a* and disengages the upper bottom castle lock 67*a* from the lower bottom castle lock 69, which is fixed to the gear housing 37, by removing the upper bottom castle lock teeth 68 from engagement with the aligned lower bottom castle lock slots 69*a*. Rotation of the locked top castle lock 64 and the upper bottom castle lock 67*a* under these circumstances facilitates rotation of the first sun gear 49 due to the splined connection with the corresponding splined shaft 58 lying alongside the first sun gear 49 and engaging the thrust bearing mount 59 (FIG. 15).

Figure 16:
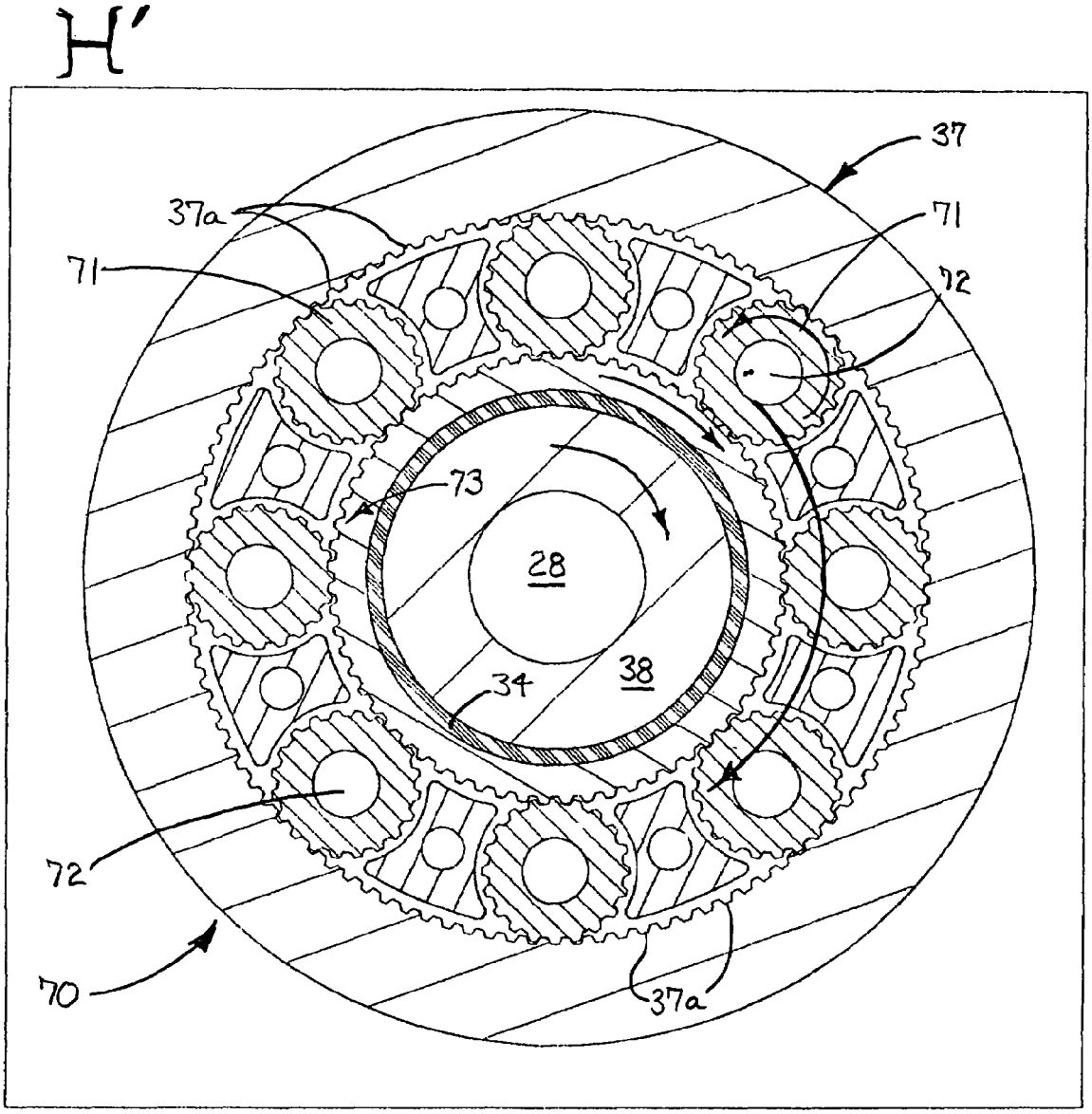
FIG. 16 is a cross-sectional view of the coiled tubing directional drilling apparatus taken along line H' in FIG. 9, more particularly illustrating the set of middle pinion gears, gear housing (ring gear) and planetary gear components of the apparatus.
Figure 17:
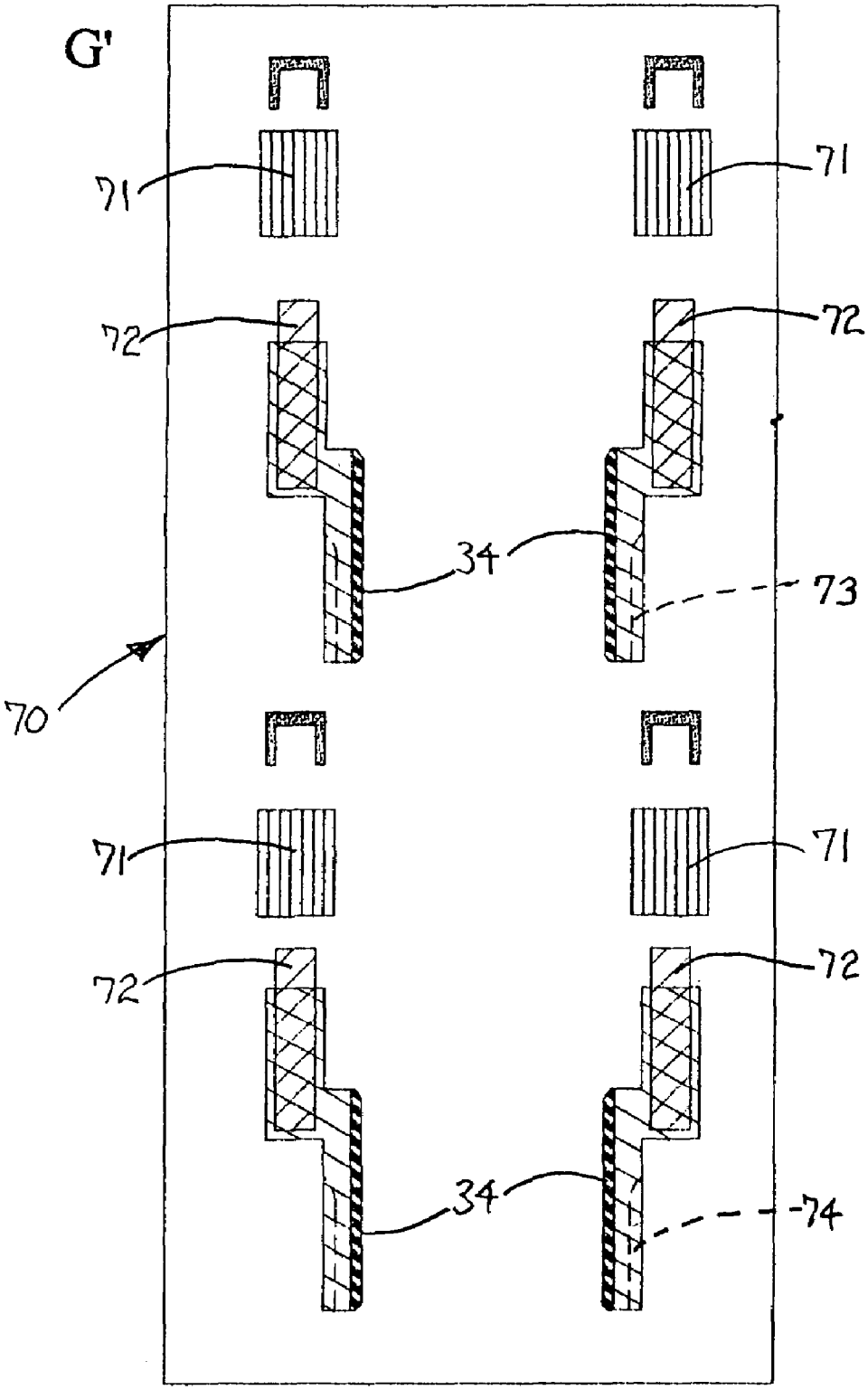
FIG. 17 is an exploded view of two sets of the preferred pinion gear and sun gear components illustrated in FIG. 9.

Referring now to FIGS. 9, 16 and 17 of the drawings the planetary pinion gear assembly 70 illustrated in FIG. 9 is designed to effect speed reduction in the 360-degree rotation of the bent section 41 and is further characterized by three sets of stacked pinion gears 71, each stack of which is individually mounted on a pinion gear shaft 72. The top array of pinion gears 71 engages the gear housing 37 at the gear housing teeth 37*a* and the first sun gear 49, as illustrated in FIG. 9, such that the top array of pinion gears 71 are rotated in concert with the rotation of the first sun gear 49. The second or middle array of pinion gears 71 also engage the ring gear or gear housing 37 at the gear housing teeth 37*a*, as well as a second sun gear 73, while the third and bottom array of pinion gears 71 engage the gear housing 37 at the gear housing teeth 37*a*, and a third sun gear 74 (FIG. 9). The third or bottom set of pinion gears 71 are located above the planetary gear sub 40 positioned above the gear bearing housing 39. The pinion gears 71 operate to cause rotation of the planetary gear sub 40 and the entire bent section 41, including the bent section housing 41*a*, the bent section CV joint connector 45, the bit box housing 46, the bit box sleeve 47*a* and the bit box 47, along with the drill bit 50. Accordingly, it will be appreciated that due to the effect of the planetary gears described above, rotation of the motor 52 with the shaft cap 61 engaged with the top castle lock 64 (FIG. 14), effects rotation of the entire bent section 41 at a speed less than the rotational speed of the mud motor drive train driving the drill bit 50. However, the drive train rotational torque is used to effect this rotation and orient the entire bent section 41, as well as the bit 50, in a desired position on a 360-degree circle in the offset leg 10 of a well bore 8, as illustrated in FIGS. 1 and 2 of the drawings. It is understood that the speed of rotation of the bent section 41 is determined by the number and size of the pinion gears 71 in the planetary gear system described above. Typical gear ratios for the three pinion gears 71 is 2:1, 8:1 and 100:1, respectively, in non-exclusive particular.

Under circumstances where it is desired to terminate rotation of the bent section 41 at a selected point in the 360-degree circle described above, operation of the electric motor 52 is reversed, typically by radio control of the motor 52, the shaft cap 61 is disengaged from the top castle lock 64, while the upper bottom castle lock 67*a* of the bottom castle lock 67 is again engaged with the lower bottom castle lock 69 (FIG. 12) to stop the bent section 41 rotation and facilitate drilling an alternative offset leg 10 in a new direction. It will be appreciated by those skilled in the art that the electric motor 52 clutch system can be replaced by a mud-operated, hydraulic or electro-magnetic system which accomplishes the same bent section 41 locking and unlocking function described above.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above:

What is claimed is:

1. A coiled tubing directional drilling apparatus comprising a fixed housing for connection to a length of the coiled tubing; a bent housing rotatably connected to said fixed housing; a drive train rotatably extending through said fixed housing and said bent housing; a drill bit connected to said drive train for drilling a hole responsive to rotation of said drive train; an access provided in said fixed housing; and a shifting apparatus carried by said drive train for rotation in said access with said drive train, said shifting apparatus also selectively engaging said fixed housing and said bent housing for selectively causing said bent housing to rotate with respect to said fixed housing.

2. The coiled tubing directional drilling apparatus of claim 1 comprising a gear assembly provided in said fixed housing and said bent housing, said gear assembly connected to said shifting apparatus for rotating said bent housing with respect to said fixed housing at a slower rotational speed than the rotational speed of said drive train responsive to operation of said shifting apparatus.

3. The coiled tubing directional drilling apparatus of claim 1 wherein said shifting apparatus comprises a power take-off assembly normally rotating with said drive train and selectively engaging said fixed housing and said bent housing for said selectively causing said bent housing to rotate with respect to said fixed housing.

4. The coiled tubing directional drilling apparatus of claim 3 comprising a gear assembly provided in said fixed housing and said bent housing, said gear assembly connected to said power take-off assembly for rotating said bent housing with respect to said fixed housing at a slower rotational speed than the rotational speed of said drive train, responsive to operation of said shifting apparatus.

5. The coiled tubing directional drilling apparatus of claim 2 wherein said gear assembly comprises at least one planetary gear disposed between said fixed housing and said bent housing for reducing the rotational speed of said bent housing with respect to said fixed housing.

6. The coiled tubing directional drilling apparatus of claim 2 wherein:

(a) said shifting apparatus comprises a power take-off assembly normally rotating with said drive train and selectively engaging said fixed housing and said bent housing for said selectively causing said bent housing to rotate with respect to said fixed housing; and (b) said gear assembly comprises at least one planetary gear disposed between said fixed housing and said bent housing for reducing the rotational speed of said bent housing with respect to said fixed housing.

7. The coiled tubing directional drilling apparatus of claim 5 wherein said gear assembly comprises three planetary gears disposed between said fixed housing and said bent housing.

8. A coiled tubing directional drilling apparatus for attachment to coiled tubing, comprising a fixed housing; a bent housing rotatably carried by said fixed housing; a drive train extending through said fixed housing and said bent housing; a mud motor provided in said fixed housing, said mud motor connected to said drive train; a drill bit connected to said drive train for drilling a hole responsive to operation of said mud motor and rotation of said drive train; and a shifting apparatus disposed for rotation in said drive train, said shifting apparatus selectively engaging said fixed housing and said bent housing for selectively causing rotation of said bent housing with respect to said fixed housing at a selected rotational speed of said bent housing.

9. The coiled tubing directional drilling apparatus of claim 8 wherein said shifting apparatus comprises a power take-off assembly normally rotating with said drive train and selectively engaging said bent housing for said selectively causing said bent housing to rotate with respect to said fixed housing.

10. The coiled tubing directional drilling apparatus of claim 8 comprising a gear assembly provided in said fixed housing and said bent housing, said gear assembly connected to said shifting apparatus for rotating said bent housing with respect to said fixed housing at a slower rotational speed than the rotational speed of said drive train responsive to operation of said shifting apparatus.

11. The coiled tubing directional drilling apparatus of claim 8 wherein said shifting apparatus comprises a power take-off assembly normally rotating with said drive train and selectively engaging said bent housing for said selectively causing said bent housing to rotate with respect to said fixed housing and comprising a gear assembly provided in said fixed housing and said bent housing, said gear assembly engaging said power take-off assembly for rotating said bent housing with respect to said fixed housing at a slower rotational speed than the rotational speed of said drive train responsive to operation of said power take-off assembly.

12. The coiled tubing directional drilling apparatus of claim 10 wherein said gear assembly comprises at least one planetary gear disposed between said fixed housing and said bent housing for reducing the rotational speed of said bent housing with respect to said fixed housing.

13. The coiled tubing directional drilling apparatus of claim 11 wherein said gear assembly comprises at least one planetary gear disposed between said fixed housing and said bent housing, said planetary gear engaging said shifting apparatus for reducing the rotational speed of said bent housing with respect to said fixed housing.

14. The coiled tubing directional drilling apparatus of claim 13 wherein said shifting apparatus comprises a power take-off assembly normally rotating with said drive train and selectively engaging said bent housing for said selectively causing said bent housing to rotate with respect to said fixed housing and said at least one planetary gear comprises a plurality of planetary gears disposed between said fixed housing and said bent housing, said planetary gear engaging said power take-off assembly for reducing the rotational speed of said bent housing with respect to said fixed housing.

15. The coiled tubing directional drilling apparatus of claim 14 wherein said plurality of planetary gears comprises three planetary gears disposed between said fixed housing and said bent housing.

16. A coiled tubing directional drilling apparatus for attachment to coiled tubing, comprising a fixed housing; a bent housing rotatably carried by said fixed housing; a drive train extending through said fixed housing and said bent housing; a mud motor provided in said fixed housing, said mud motor connected to said drive train; a drill bit connected to said drive train for drilling a hole responsive to operation of said mud motor and rotation of said drive train; and a clutch apparatus disposed for rotation in said drive train, said clutch apparatus selectively engaging said fixed housing and said bent housing for selectively causing rotation of said bent housing with respect to said fixed housing at a selected rotational speed.

17. The coiled tubing directional drilling apparatus of claim 16 comprising a gear assembly provided in said fixed housing and said bent housing, said gear assembly connected to said clutch apparatus for rotating said bent housing with respect to said fixed housing at a slower rotational speed than the rotational speed of said drive train responsive to operation of said clutch apparatus.

18. The coiled tubing directional drilling apparatus of claim 16 wherein said clutch apparatus comprises a power take-off assembly normally rotating with said drive train and selectively engaging said fixed housing and said bent housing for said selectively causing said bent housing to rotate with respect to said fixed housing.

19. The coiled tubing directional drilling apparatus of claim 17 wherein said clutch apparatus comprises a power take-off assembly normally rotating with said drive train and selectively engaging said fixed housing and said bent housing for said selectively causing said bent housing to rotate with respect to said fixed housing and said gear assembly comprises at least one planetary gear disposed between said fixed housing and said bent housing, said planetary gear engaging said shifting apparatus for reducing the rotational speed of said bent housing with respect to said fixed housing.

20. The coiled tubing directional drilling apparatus of claim 19 wherein said at least one planetary gear comprises a plurality of planetary gears engaging said fixed housing, said bent housing and said power take-off assembly for reducing the rotational speeds of said bent housing with respect to said fixed housing.

* * * * *